US012454801B2

(12) United States Patent
Portmann

(10) Patent No.: US 12,454,801 B2
(45) Date of Patent: Oct. 28, 2025

(54) MILLING HEAD FOR MACHINING PILE HEADS

(71) Applicant: BRC ENGINEERING AG, Rain (CH)

(72) Inventor: Alois Portmann, Rain (CH)

(73) Assignee: BRC ENGINEERING AG, Rain (CH)

( * ) Notice: Subject to any disclaimer, the term of this patent is extended or adjusted under 35 U.S.C. 154(b) by 266 days.

(21) Appl. No.: 18/267,703

(22) PCT Filed: Jan. 13, 2022

(86) PCT No.: PCT/EP2022/050637
§ 371 (c)(1),
(2) Date: Jun. 15, 2023

(87) PCT Pub. No.: WO2022/161782
PCT Pub. Date: Aug. 4, 2022

(65) Prior Publication Data

US 2024/0018735 A1 Jan. 18, 2024

(30) Foreign Application Priority Data

Jan. 28, 2021 (EP) ..... 21154111

(51) Int. Cl.
*E02D 5/64* (2006.01)
*E02D 9/00* (2006.01)

(52) U.S. Cl.
CPC ..... *E02D 5/64* (2013.01); *E02D 9/005* (2013.01)

(58) Field of Classification Search
CPC ..... B28D 1/18; B28D 1/181; B28D 1/188; E02D 5/64; E02D 7/30; E02D 37/00;
(Continued)

(56) References Cited

U.S. PATENT DOCUMENTS

2008/0047757 A1* 2/2008 Schwab ..... E21B 10/44 175/121
2010/0109420 A1 5/2010 Portmann et al.

FOREIGN PATENT DOCUMENTS

CN 111980576 A * 11/2020 ..... E21B 4/14
DE 10041275 A1 3/2002
(Continued)

OTHER PUBLICATIONS

May 9, 2022 International Search Report issued in International Patent Application No. PCT/EP2022/050637.
(Continued)

*Primary Examiner* — Sunil Singh
(74) *Attorney, Agent, or Firm* — Oliff PLC

(57) ABSTRACT

A milling head, having a rotation axis and which serves for machining a pile head of a pile that includes a pile core, a pile jacket and a metal armouring interposed therebetween, includes a coupling device, connected to a drive shaft of a driving device, a central milling cutter, which includes a plurality of central chisels mounted on a lower side of an inner ring plate, and a ring milling cutter, which includes a plurality of ring chisels mounted on a lower side of an outer ring plate, which central milling cutter and ring milling cutter are connected to each other coaxially aligned with the rotation axis, and which outer ring plate surrounds the inner ring plate separated thereof by a middle circular ring area. The inner ring plate includes at least one transfer opening leading from the lower side to the upper side of the inner ring plate.

16 Claims, 10 Drawing Sheets

(58) Field of Classification Search
CPC . E02D 5/30; E21B 7/005; E21B 10/44; E21B 17/22
USPC ..... 405/241, 249
See application file for complete search history.

(56) References Cited

FOREIGN PATENT DOCUMENTS

| | | | |
|---|---|---|---|
| EP | 1093898 | A2 | 4/2001 |
| EP | 1990167 | A1 | 11/2008 |
| WO | 98/42916 | A1 | 10/1998 |
| WO | 2008/135365 | A1 | 11/2008 |

OTHER PUBLICATIONS

May 9, 2022 Written Opinion issued in International Patent Application No. PCT/EP2022/050637.

* cited by examiner

MILLING HEAD FOR MACHINING PILE HEADS

BACKGROUND

The invention relates to a milling head for machining pile heads.

WO2008135365A1 discloses a milling head for machining pile heads of piles, which comprise a pile core and a pile jacket and a metal armouring provided between the pile core and the pile jacket.

Concrete piles of this kind which are to be machined, are typically provided in unstable ground for the support of a construction object, consist of concrete that can be subjected to pressure and reinforcing steel that can be subjected to tension. The dimensions of the piles are chosen according to the construction object and the ground and can vary over a wide range. Typically, piles with lengths of 5 m-50 m and diameters of 0.4 m-2.5 m are used. To construct the piles, holes are drilled into the ground into which pipes are inserted. The armouring iron is inserted into the pipes and the concrete is poured in. Earth material at the bottom of the pipe is usually displaced upwards and is found at the top of the pile when it is completed, which is why it does not comprise the required strength. Furthermore, the pile or pile head usually does not comprise the required dimensions. The pile head may also lack the coupling elements required for the construction object. The pile head is therefore usually machined and rebuilt in the required dimensions and quality.

For this purpose, the prefabricated, normally cylindrical pile head is machined by means of a milling head typically over a length in the range of 0.5 m-1.5 m in order to remove deficient concrete. The concrete must be removed in such a way that the typically sleeve-shaped armouring iron, which is typically arranged coaxially to the rotation axis of the pile, as well as intact concrete below the pile head are not damaged. After removing the deficient or excess concrete and uncovering the armouring, it is normally extended with supplementary armouring and provided with a formwork that corresponds to the dimensions of the new pile head to be constructed. The formwork is then filled with concrete and removed after the concrete has consolidated.

Traditionally, when working on pile heads, the pile core was milled out to the border of the armouring iron. Subsequently, the pile jacket was milled down to the armouring iron. This process not only took usually a long time, but also often resulted in damage to the armouring. Furthermore, especially when working on the pile jacket, splitting of the previously intact concrete occurred, which considerably reduced the available cross-section of the concrete pile, so that the surface pressure transferred from the concrete pile to the built-up object increased accordingly. Corresponding damage to a concrete pile therefore often resulted in considerable consequential damage to the object that was built on defective pile heads. In order to avoid such consequential damage, defective piles and pile heads had to be repaired at great expense and effort.

When working on pile heads, therefore, not only the time factor plays an important role, but also in particular the high-quality completion of the pile heads, which form a crucial part of the foundation of the construction object, for example a building or a bridge.

With the milling head disclosed in WO2008135365A1, which is mounted on a construction vehicle, such as an excavator, substantial progress has been made with regard to the machining time of a pile head as well as with regard to the quality of the machining. This milling head comprises a coupling device connectable to a drive shaft, a central milling cutter provided with a plurality of central chisels and a ring milling cutter provided with a plurality of ring chisels, which central milling cutter and ring milling cutter are fixedly coupled to each other and coaxially aligned with the rotation axis of the drive shaft. This milling head allows the pile core and the pile jacket to be removed simultaneously without damaging the pile armouring located between the central milling cutter and the ring milling cutter.

SUMMARY

Despite the significant improvement in the machining of pile heads achieved with this milling head, the demand remained to develop a milling head that would allow pile heads to be machined even faster and more carefully. However, increasing the working speed of a device usually leads to qualitatively poorer work results, which is not permissible with regard to the fundamental importance of the machined objects of the pile heads.

The present invention is therefore based on the object of creating an improved milling head for the machining of pile heads.

By means of the milling head, pile heads of concrete piles shall be machined simultaneously with reduced force, with higher working speed and with higher working quality. The milling head shall be able to penetrate more advantageously into the pile head, the pile core and the pile jacket, so that concrete material can be removed with reduced force and, by reducing the force, at the same time reducing the risk of damage to the machined pile head.

When machining the pile heads, the concrete shall be treated gently so that accelerated material removal does not result in cracks and fissures in the pile head. At the same time, the load on the milling tools or chisels shall be reduced so that the maintenance effort for the milling head is also reduced accordingly.

By means of the milling head, it shall be ensured in particular that no splitting occurs in the pile jacket during the machining of a pile head, which, depending on the size, would result in correspondingly high repair efforts.

The central drill unit and milling tools shall also be advantageously mountable and dismountable in the desired number, so that also in this respect a low maintenance effort results and the milling head can be configured and adapted to the piles to be machined, which may comprise a diameter of more than 2 m, with little effort.

This task is solved with a milling head which comprises the features specified in claim 1. Advantageous embodiments of the invention are specified in further claims.

The milling head is used for machining a pile head of a pile typically a concrete pile comprising a pile core, a pile jacket and a metal armouring located between the pile core and the pile jacket.

The milling head, which in use is rotated about its longitudinal or rotation axis, comprises a coupling device connectable to a drive shaft of cutter comprising a plurality of a driving device, a central milling central chisels mounted on the lower side of an inner ring plate, and a ring milling cutter comprising a plurality of ring chisels mounted on the lower side of an outer ring plate, wherein the central milling cutter and the ring milling cutter are connected to each other in coaxial alignment with the rotation axis, and which outer ring plate surrounds the inner ring plate separated thereof by a middle circular ring area.

According to the invention, the inner ring plate comprises at least one transfer opening leading from the lower side to the upper side of the inner ring plate, which transfer opening is adjoined on the lower side by a conveyor shovel projecting at least partially into a working area of the central chisels and which transfer opening is adjoined on the upper side by a conveyor spiral.

With the milling head according to the invention, it is possible to simultaneously remove segments of the pile core and the pile jacket without damaging the armouring of the pile located in the central circular ring area. The machining is carried out with high precision so that the concrete can be removed even at a small distance of a few centimetres from the armouring. The remaining thin concrete sleeve, in which the armouring is enclosed, can then be quickly removed using another tool, for example pliers.

It is particularly advantageous that the segments of the pile core and the pile jacket can be removed by linear lowering of the milling head. Complex movements of a tool, which are difficult to execute and can lead to damage to the pile head, are no longer necessary. The pile head can therefore be machined in a short time without causing damage.

Due to the linear displacement of the milling head and the correspondingly calculable force effects on the tools, the loads and the wear of the milling head are also reduced, which is why maintenance is only necessary at longer intervals.

The at least one conveyor shovel which extends into the working area of the chisels allows the milling material removed from the concrete core to be collected and fed through the associated transfer opening to the associated conveyor spiral. By removing the milled material, a major obstacle is removed from the working area of the chisels, allowing the milling head to rotate with reduced resistance and the central chisels to penetrate the pile core with reduced resistance. On the one hand, the efficiency of the milling tools is increased and on the other hand, their load is reduced.

By means of the inventive milling head, a systematic material flow is thus realised, which relieves the milling process and allows efficient removal of the pile core and the pile jacket. Due to the systematic material flow through the at least one transfer opening, the inner ring plate can be provided with a large surface area for the assembly of central chisels. The large mounting surface of the inner ring plate does therefore not impair the material flow. Therefore, a desired number of central chisels can be mounted on the lower side of the inner ring plate.

The milled material can be removed particularly efficiently if the inner ring plate is provided with two transfer openings, to each of which a conveyor shovel, which is projecting at least partially into the working area of the central chisels, adjoins on the lower side and a conveyor spiral adjoins on the upper side. To allow the milling material to flow into the conveyor spirals with minimum resistance, it each transfer opening is preferably adjoined by a connecting surface on the upper side of the inner ring plate, which ensures a laminar or unobstructed transition from the conveyor shovel to the associated conveyor spiral.

Preferably, the transfer openings and the conveyor shovels and the central chisels are arranged in pairs diametrically opposite each other and at equal distances from the rotation axis. The conveyor shovels, the central chisels and the ring chisels are preferably also provided in pairs at the same height. This ensures that the diametrically opposed tools or chisels always act in the same way on the pile head and that disturbing moments or forces caused by asymmetries, which could stress the milling head and disturb its guidance, are avoided. The milling head can therefore be optimally guided and operated with a minimum of force. Forces acting laterally on the milling head, which could be unfavourable for the installed tools, such as the chisels and the preferably provided central drill unit, are avoided.

Preferably, the inner ring plate is connected to the lower side of a shaft and the outer ring plate is connected to the lower side of a mounting cylinder, whereby the shaft and the mounting cylinder are aligned coaxially to the rotation axis and are connected at the upper side to a coupling plate on which the coupling device is arranged. The mounting cylinder preferably comprises at least one exit window through which the conveyed milling material can be discharged, and at least one mounting window which allows manual access to, for example, to the coupling device.

In a further preferred embodiment, the at least one conveyor spiral or two conveyor spirals, preferably turned 180° relative to each other, is or are provided with a side wall in a lower section, which is preferably selected according to the height of the pile heads to be machined. The side wall ensures that the milled material in the lower section cannot escape from the conveyor spirals and can be conveyed out of the remaining area of the pile head that comprises the armouring. Only after the milling material has been conveyed out of this area can it exit laterally in an upper section of the conveyor spiral, which is not provided with a side wall, and be led away from the milling head via the at least one exit window. The side wall of the conveyor spiral thus ensures the transport of material from the inner ring plate to an area of the conveyor spiral where the milling material is led away laterally. The side wall can be integrally formed or welded onto the conveyor spiral, which is made for example of sheet metal.

On the lower side of the inner ring plate there is preferably a central drill unit coaxially aligned with the rotation axis, which extends beyond the central chisels and the ring chisels in the milling direction, and therefore penetrates first into the pile head or the pile core and thereby performs a guiding function or pilot function and ensures that the central chisels and ring chisels can follow circular working paths.

In further preferred embodiments, the at least one radial shovel is provided on the lower side of the inner ring plate, which is connected to the central drill unit and is preferably aligned at least approximately radially with respect to the rotation axis. Preferably, the at least one radial shovel extends from the central drill unit to the at least one transfer opening. Preferably, therefore, a radial shovel is associated with each transfer opening. The at least one radial shovel, which is, for example, a straight or curved plate, ensures that milling material released from the central drill unit and from radially inner central chisels is guided outwards towards the associated transfer opening. The course of the lower edge or front edge of the radial shovel, as well as the course of the lower edge or front edge of the conveyor shovel, is selected in such a way that contact with the pile core is always avoided. The radial shovel is therefore overlapped by the neighbouring central chisels in the conveying direction.

The inner ring plate can advantageously fulfil numerous functions according to the inventive principle. On the lower side of the inner ring plate, mounting holes can be provided for receiving the central chisels and/or the radial shovels and/or a receiving aperture for receiving a mounting part or drill chuck, which serves to releasably hold the central drill unit. The drill chuck comprises, for example, a locking part by means of which the central drill unit can be fixed in the drill chuck and, if necessary, released again.

On the upper side of the inner ring plate a receiving aperture can be provided to receive the shaft connecting the inner ring plate to the coupling device.

The connection of the mounting part or drill chuck and the shaft to the inner ring plate can be made by known mechanical connection techniques, such as by a press fit and/or by a thread. For the mounting of the central chisels, holders are preferably provided which are inserted into the mounting holes. The central chisels and the central drill unit can therefore be advantageously connected to the inner ring plate, which is why maintenance work can be carried out advantageously. In the event of a defect or necessary maintenance, no welding work is required. Instead, the central chisels and the central drill unit can be easily detached and replaced.

In further preferred embodiments, the central chisels are radially spaced from each other at equal or unequal chisel spacing on circular lines or working circles, whereby the uniform chisel spacing or the different chisel spacing between the working circles preferably lies in a range of 20 mm-40 mm.

During operation or rotation of the milling head around the rotation axis, the central chisels preferably run in pairs and diametrically opposite each other in the same work circles, which are spaced apart from each other. By spacing the central chisels or the work circles radially in a range of 20 mm-40 mm, a particularly efficient removal of the material of the pile core is achieved. If the distance is greater than 40 mm, too little material is removed and if the distance is less than 20 mm, penetration of the central chisels is only possible with considerably increased force, which is preferably avoided to prevent damage to the pile head and the milling head. Ideally, the chisel spacing is within the range of 25 mm-35 mm.

The inner ring plate is preferably offset forward in the milling direction relative to the outer ring plate, so that the central chisels are also offset forward relative to the ring chisels. For example, there is an axial displacement of 10 mm-25 mm.

Alternatively, or additionally, the mounting height of the central chisels in the milling direction preferably changes from work circle to work circle by a height difference that is in the range of 5 mm-25 mm and increases in the direction of the rotation axis.

During operation of the milling head, the central drill unit therefore first penetrates the pile core. Then the central chisels penetrate the pile core in pairs, sequentially and in stages, so that the pile core is machined from the inside to the outside. The surface tension of the pile core is therefore gradually broken by the graduated arrangement of the central chisels. Instead of breaking the surface of the pile core in one step, the surface tension is broken step by step and thus with reduced force. The inventive milling head can therefore be operated efficiently with reduced force or reduced drive torques.

In another preferred embodiment, the mounting heights of the ring chisels in the milling direction are also selected differently. Preferably, the mounting height in the milling direction increases from ring chisel to ring chisel or from work circle to work circle of the ring chisels radially outwards in steps with a height difference that is preferably in the range of 5 mm-25 mm.

Since the ring chisels located at the outermost edge of the outer ring plate are displaced farthest downwards in the milling direction against the pile head, the outermost edge of the pile jacket is milled off first. The pile jacket is therefore milled from the outside inwards, which avoids splitting. The surface tension of the pile jacket is therefore broken at the outer edge, after which the pile jacket is gradually removed inwards.

The central chisels and ring chisels are preferably mounted in at least two spiral rows on the lower side of the inner ring plate and the outer ring plate respectively. The chisel height of the central chisels preferably increases, as described, linearly or non-linearly sequentially from central chisel to central chisel in the direction of the rotation axis or in the direction of the central drill unit radially inwards. The chisel height of the ring chisels, on the other hand, preferably increases, as described, linearly or non-linearly sequentially from ring chisel to ring chisel radially outwards to the edge of the outer ring plate.

The central drill unit and the central chisels lying at different mounting heights and the ring chisels lying at different mounting heights form in their engagement area or with the corresponding working circles a wave form running concentrically to the rotation axis, which has a maximum in the area of the rotation axis in the milling direction, which has a minimum in the area of the central circular ring surface and which rises again towards the outer edge of the outer ring plate in the milling direction. The wave shape ensures optimum engagement of the milling head in the pile head, which Can thus be machined efficiently but also gently. The surface tensions in the pile core and in the pile jacket are advantageously broken, which is why a rapid material removal takes place with reduced energy requirements and at the same time damages, such as splitting of the pile jacket, are avoided. The invention therefore combines these three essential advantages, which are normally mutually exclusive. With a reduced energy input, a faster and gentler material removal takes place. It should be noted that the milling process is favoured on the one hand by the inventive disposal of the milling material and on the other hand by the advantageous arrangement of the central chisels and/or the ring chisels.

The at least one conveyor shovel has a front edge that extends from an inner edge closer to the rotation axis to an outer edge farther away from the rotation axis. The conveyer shovel or conveyer shovels are arranged and aligned in such a way that contact with the pile head is avoided and the loosened milling material is securely gripped and efficiently transferred to the associated conveyor spiral. The milled material, which is conveyed radially outwards from the radial shovels to the transfer openings, is collected by the conveyor shovels and conveyed upwards to the conveyor spirals. The milling material loosened by the outer central chisels, on the other hand, is first collected on the outside by the conveyor shovels and transferred into material flow that runs inwards and upwards to the conveyor spirals. This prevents milling material from collecting peripherally at the inner ring plate and obstructing the milling process or the rotation of the milling head. The conveyor shovels preferably comprise external shovel walls so that the material collected by the conveyor shovel is not thrown outwards by centrifugal forces.

In preferred embodiments, at least one clearing tool, for example a chisel, is therefore additionally provided, which grips material at the periphery of the inner ring plate and deflects it inwards. The clearing tool or the clearing chisel preferably projects radially outwards beyond the inner ring plate by a clearance width which is preferably in a range of 5 mm-40 mm.

Preferably, the front edge of the conveyor shovels is horizontally inclined relative to the diameter of the inner ring plate by a horizontal inclination angle in such a way that, when the milling head rotates in the working direction, the outer edge of the respective conveyor shovel precedes, and the inner edge follows behind. The horizontal inclination angle, which is preferably in a range of 5°-25°, ensures that the milling material is peripherally gripped and guided towards the centre of the conveyor shovel.

Preferably, the front edge of the conveyor shovels is vertically inclined relative to the diameter of the inner ring plate by a vertical inclination angle in such a way that the inner edge is preferably higher than the outer edge in accordance with the course of the assembly height of the central chisels. The vertical inclination angle is preferably selected in accordance with the height of the central chisels in such a way that between the tips of the central chisels and the front edge of the conveyor shovels there is a shovel spacing or a distance from the chisel tips and thus from the surface of the pile core in the range of 5 mm-40 mm.

The conveyor shovels are further inclined at a vertical inclination angle of the shovel with respect to the rotation axis, the front edge of the conveyor shovels leading during operation of the milling head and the vertical inclination angle of the shovel preferably being in a range between 5° and 85°.

The at least one radial shovel and/or the at least one conveyor shovel are preferably at least partially in a form-fitting manner in a recess or mounting hole provided in the inner ring plate. In this way, the radial shovels and the conveyor shovels can be easily mounted and dismounted. The at least one radial shovel and/or the at least one conveyor shovel, on the other hand, can also be completely or partially welded to the inner ring plate, whereby it is preferably provided that the radial shovel and the conveyor shovel at least partially lie flat against a support surface of the inner ring plate.

The central chisels provided on the central milling cutter and the ring chisels provided on the ring milling cutter preferably comprise a weldable or form-fitting mount and a chisel element which can be inserted therein, and which can be replaced routinely. Preferably, the holders are connected to the corresponding holders or mounting elements of the ring plates by means of form-fit connections, for example dovetail connections. The ring chisels are preferably slightly larger than the central chisels. Furthermore, one of the ring chisels can be connected to the inner ring plate as a clearing chisel.

The inner and outer diameters of the inner ring plate and the outer ring plate are preferably precisely adapted to the dimensions of the pile and the position of the armouring in the pile, so that maximum removal of concrete is ensured without damaging the armouring. The milling head is therefore provided according to the dimensions of the pile head to be machined, which may comprise an outer diameter of more than 2 m.

Preferably, central milling cutters and ring milling cutters of any dimensions can be combined with each other or connected to each other by the coupling plate. Furthermore, outer ring plates of different dimensions and/or equipped with different tools can preferably be releasably connected to the mounting cylinder. Furthermore, inner ring plates of different dimensions and/or equipped with different tools can preferably be releasably connected to the shaft. In this way, the milling head can be flexibly adapted to the pile heads to be machined.

The milling head is made of resistant material, especially iron and steel. The tool parts that come into contact with the concrete pile are preferably made of hard metal. Typically, the milling tools include receiving apertures in which carbide elements are inserted for machining the concrete. The use of plastic parts is possible if these have the desired strength and should give the milling head or parts thereof a certain elasticity, for example.

BRIEF DESCRIPTION OF THE DRAWINGS

Below, the invention is explained in more detail with reference to the drawings. Thereby shows.

Figures 2, 7A, 7B:
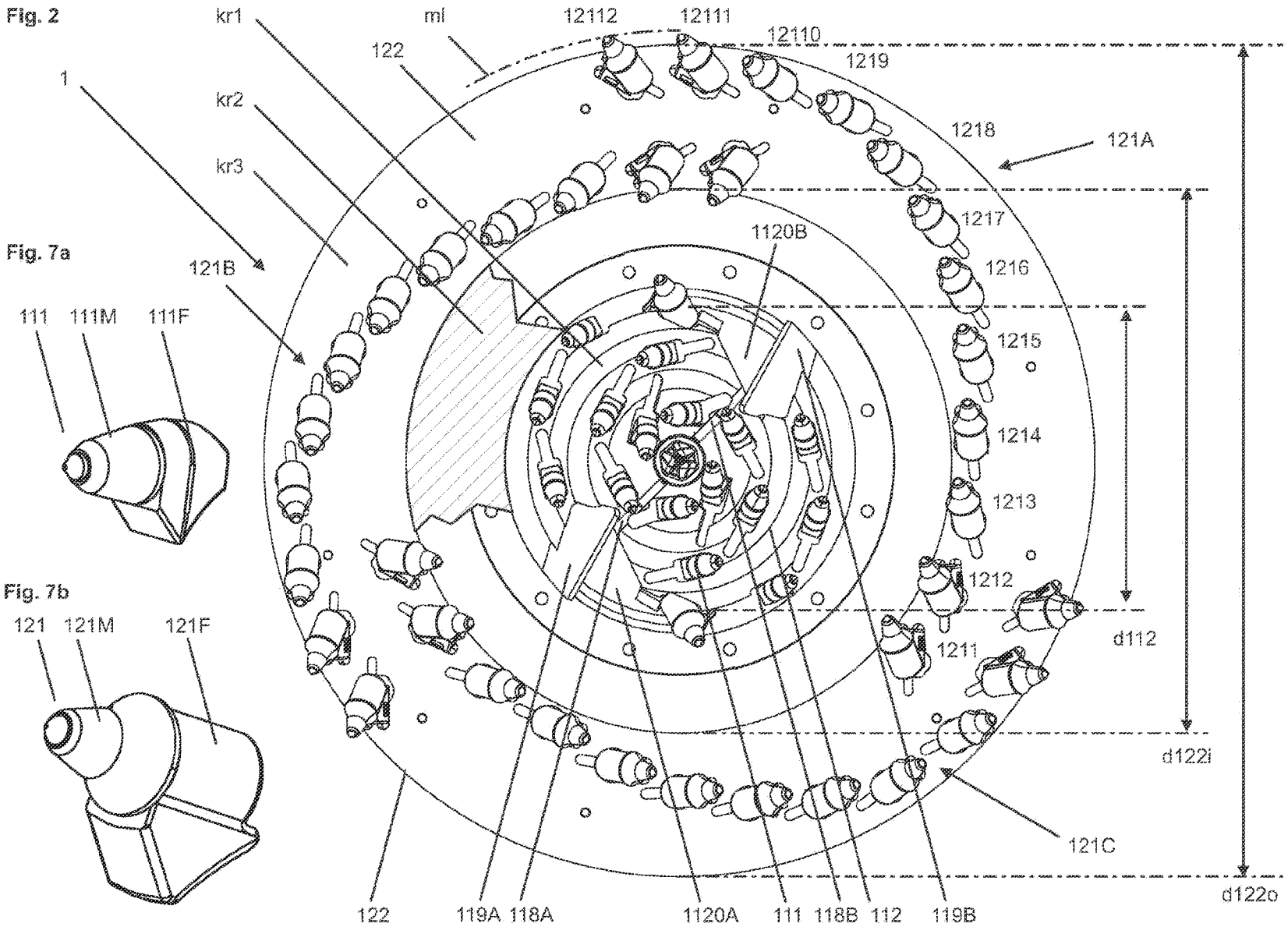
FIG. 2 the milling head 1 of FIG. 1*a* from below with a view of the inner ring plate 112 equipped with the central chisels 111 and the outer ring plate 122 equipped with the ring chisels 121, which cover a central circular ring area kr1 corresponding to the pile core 81 and an outer circular ring area kr3 corresponding to the pile jacket 82 in accordance with the geometry of the machined pile 8 and delimit a middle circular ring area kr2, into which a concrete sleeve 88 with the iron armouring 83 remaining after the machining of the pile head 80 can enter.
Figure 6A:
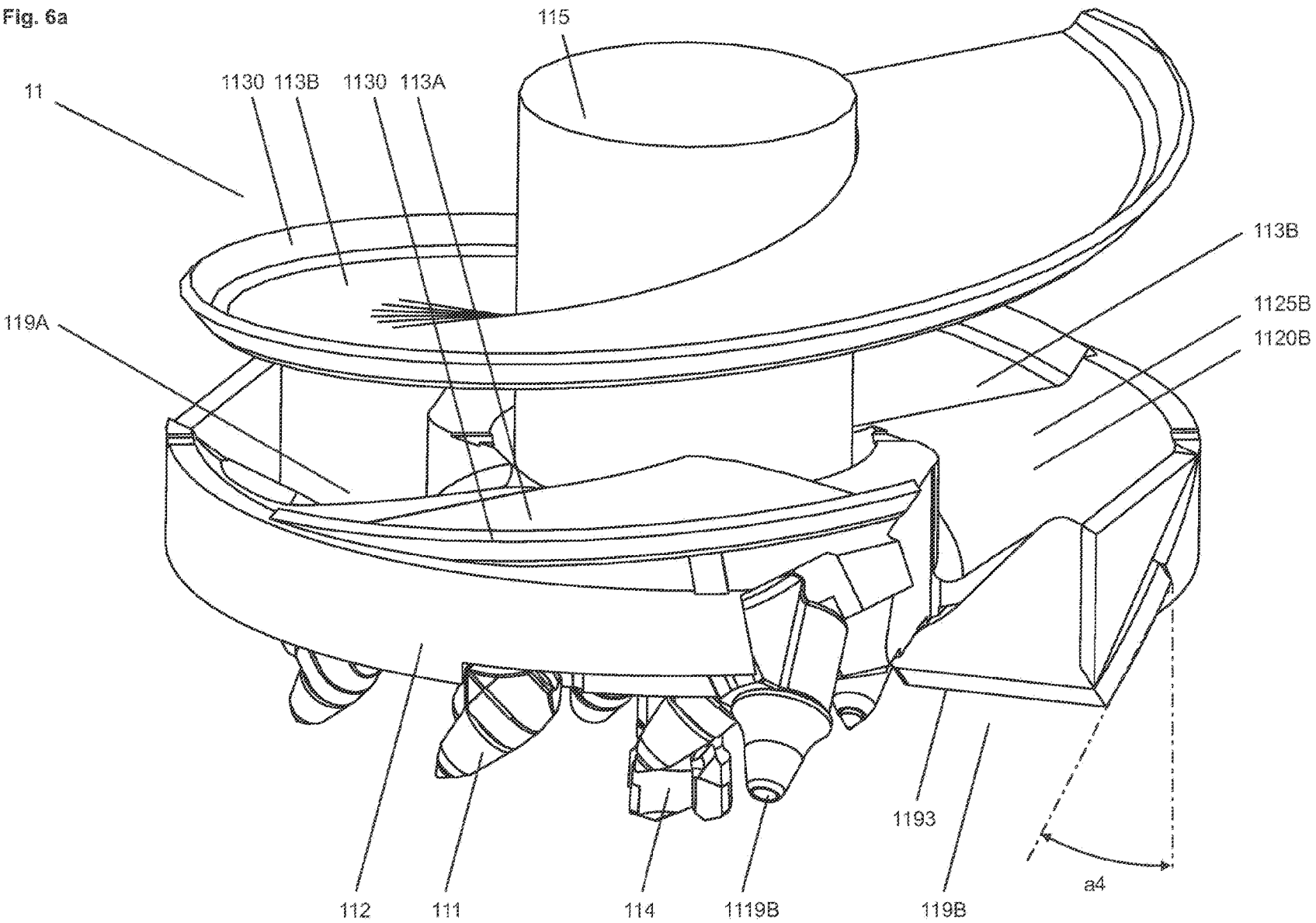
FIG. 6*a* the inner ring plate 112 of FIG. 5*a* from above with the conveyor spirals 113A, 113B adjoining the upper side of the inner ring plate 112, which are turned by 180° relative to each other around the shaft 115 of the central milling cutter 11 and which are each provided in this section with a spiral wall 1130, as well as in front view the transfer opening 1120B, which is adjoined on the lower side by the conveyor shovel 119B projecting into the working area of the central chisels 111 and which is adjoined on the upper side by the conveyor spiral 113B.
Figure 6B:
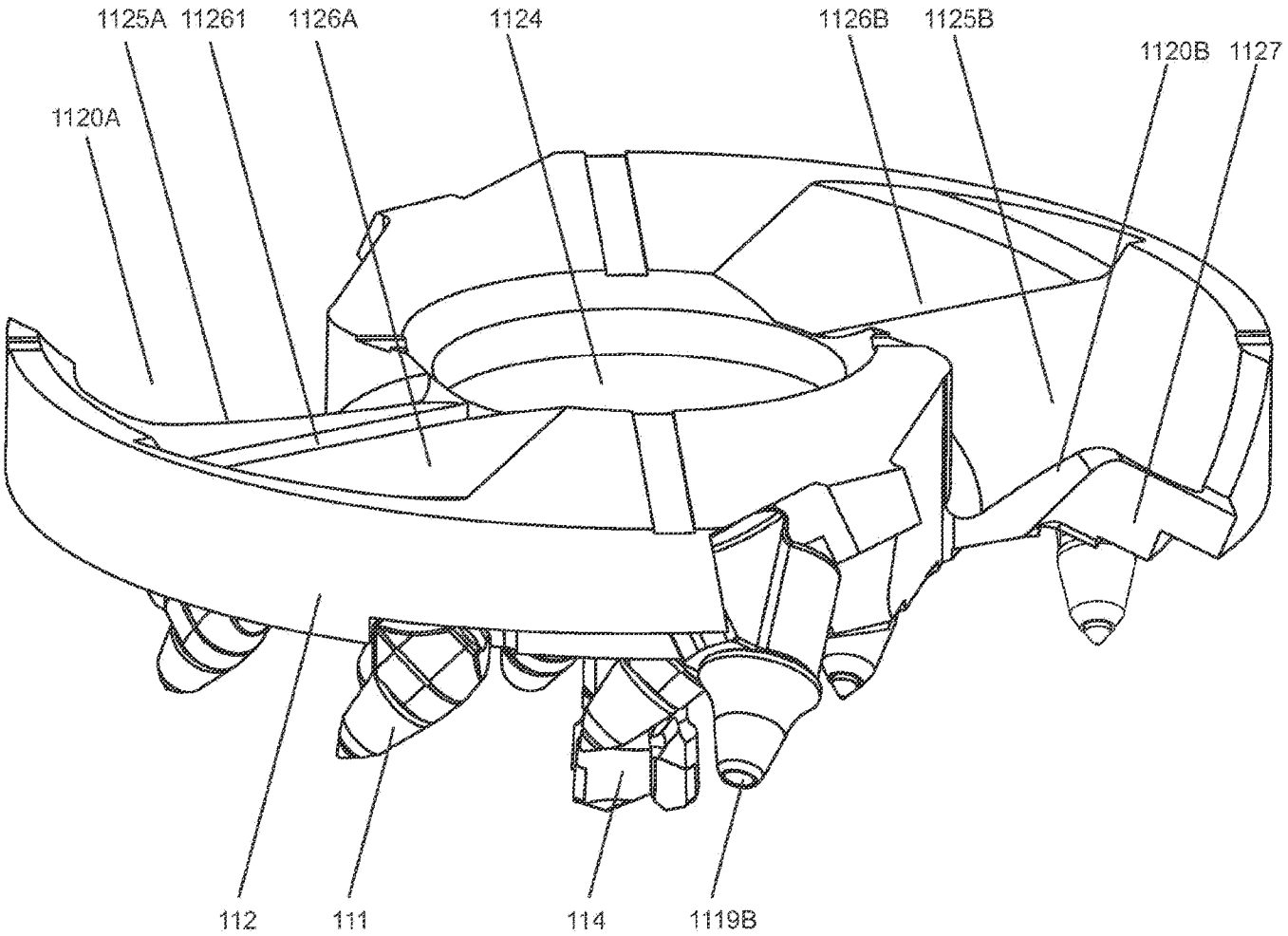

FIG. 6*b* the inner ring plate 112 of FIG. 6*a* with the transfer openings 1120A, 1120B and without the conveyor spirals 113A, 113B, the shaft 115 and the conveyor shovel 119B;

FIG. 7*a* a central chisel 111 comprising a holder 111F and a chisel element 111M inserted therein; and FIG. 7*b* a ring chisel 121 comprising a holder 121F and a chisel element 121M inserted therein.

DETAILED DESCRIPTION OF EMBODIMENTS

Figure 1A:
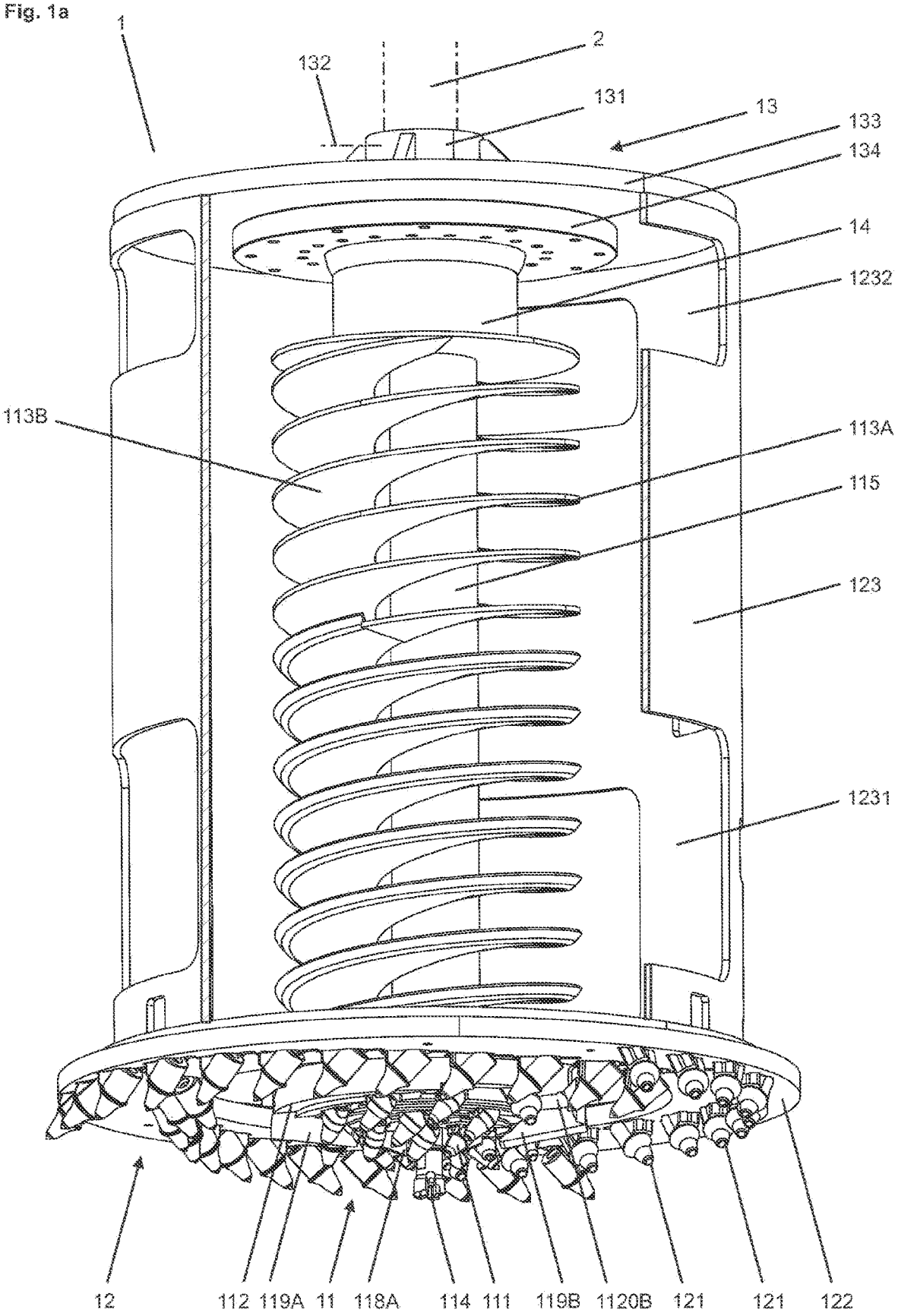
FIG. 1*a* a sectional view of an inventive milling head 1 for machining pile heads 80, comprising a coupling device 13, a ring milling cutter 12, which comprises a plurality of ring chisels 12 mounted on the lower side of an outer ring plate 122, and a central milling cutter 11, which comprises an inner ring plate 112, on the lower side of which inner ring plate 112 plurality of central chisels 111 are provided and two conveyor shovels 119A, 119B are mounted adjacent to transfer openings 1120A, 1120B, through which loosened milling material can be conveyed from the working area of the central chisels 111 to conveyor spirals 113A, 113B.
Figure 1B:
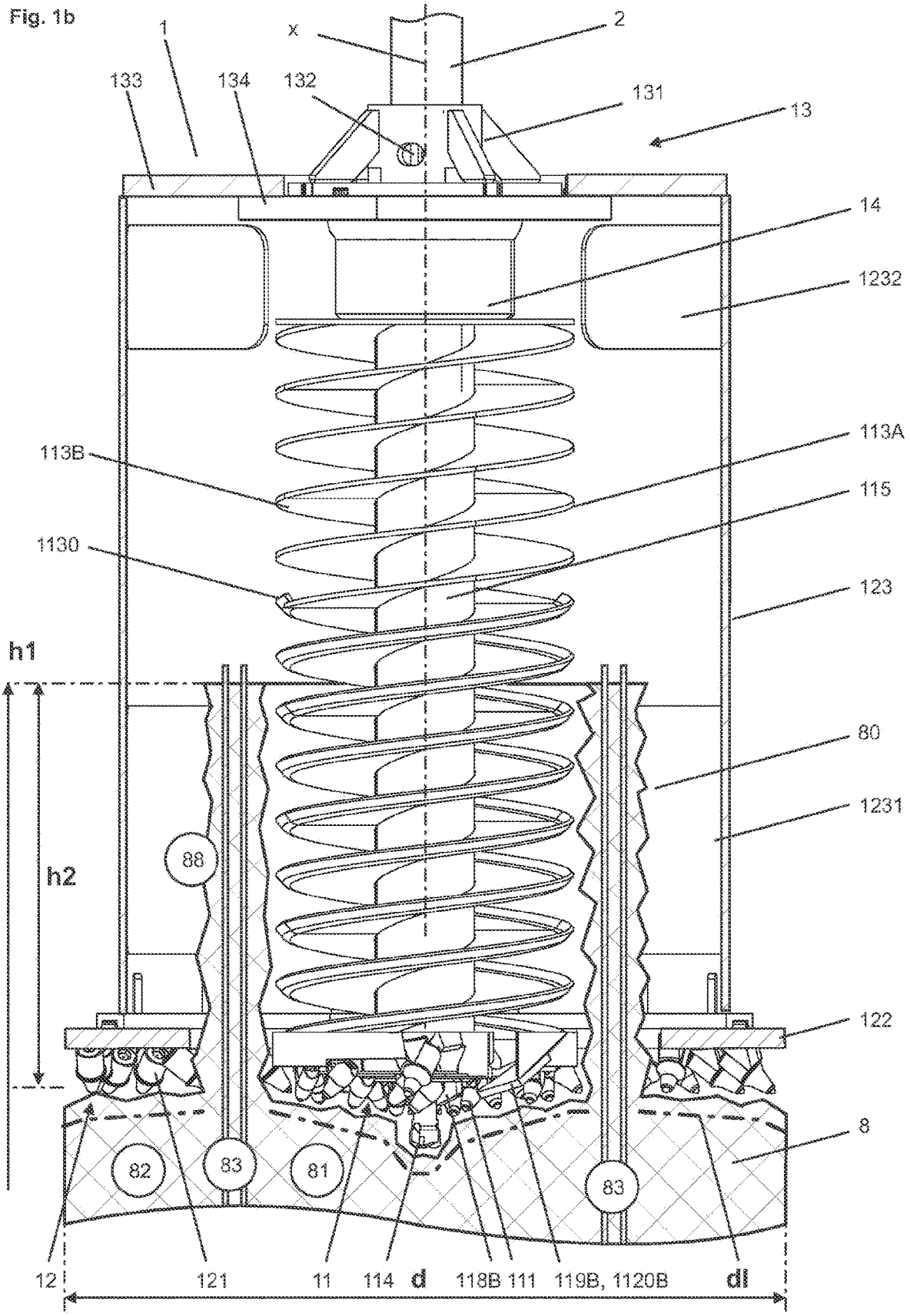
FIG. 1*b* the milling head 1 of FIG. 1*a* during the machining of a pile head 80, whose pile core 81 and pile jacket 82, between which the undamaged iron armouring 83 is held in a relatively thin concrete sleeve 88, have already been removed at the height h2.

FIG. 1*a* shows a sectional view of an inventive milling head 1, which, as FIG. 1*b* shows, is designed for machining pile heads 80 of concrete piles 8.

The milling head 1 comprises a central milling cutter 11 and a ring milling cutter 12, which are connected to each other at their upper side by a coupling plate 133 and a counter plate 134 and to a coupling device 13. The coupling device 13 comprises a coupling sleeve 131, into which a drive shaft 2 of a drive device (not shown) can be inserted and locked, for example, by means of a bolt 132. The drive shaft 2 is held, for example, by a construction vehicle which is able to rotate and axially displace the drive shaft 2 about a rotation axis x or about the longitudinal axis of the milling head 1. The milling head 1 can therefore be rotationally lowered coaxially onto a pile head 80 to machine it, as shown in FIG. 1*b*. In all embodiments, the milling head 1 is rotated clockwise as seen from above.

The ring milling cutter 12 comprises an outer ring plate 122, on the lower side of which ring chisels 121 are mounted aligned in the direction of rotation or inclined thereto. The upper side of the outer ring plate 122 is preferably releasably connected, for example by means of flange elements and screws or threaded elements, to the lower side of a mounting cylinder 123, the upper side of which is preferably releasably connected, for example by means of flange elements and screws or threaded elements, to the coupling plate 133. The mounting cylinder 123 is shown with a quarter section exposing the view of the central milling cutter 11. On the lower side, the mounting cylinder 123 comprises exit windows 1231 through which loosened milling material can be guided away to the outside. On the upper side, the mounting cylinder 123 comprises mounting windows 1232, which allow engagement in the milling head 1, for example to release the central milling cutter 11.

The central milling cutter 11 comprises an inner ring plate 112, on the lower side of which central chisels 111 are mounted aligned in the direction of rotation or inclined thereto. Coaxially aligned with the rotation axis x, a central drill unit 114 is provided on the lower side of the inner ring plate 112, which projects downwards in the milling direction beyond the central chisels 111 and the ring chisels 121. The inner ring plate 112 further comprises two transfer openings 1120A, 1120B (see FIG. 3*a*), which are diametrically opposite each other with respect to the rotation axis x, and to each of which a radial shovel 118A, 118B and a conveyor shovel 119A, 119B are assigned.

On the upper side, a conveyor spiral 113A, 113B adjoins each of the transfer openings 1120A, 1120B. The conveyor spirals 113A, 113B, which upwards enclose a shaft 115, are preferably formed from a solid sheet of metal. The lower side of the shaft 115 is connected to the inner ring plate 112 and is preferably releasably held at the upper side by a connecting device 14. The shaft 115 is connected to the coupling device 13 by means of the connecting device 14 in a force-locking and/or form-locking manner. The connecting device 14 preferably comprises clamping devices distributed along the circumference of the shaft 115, which allow the shaft 115 to be clamped to the counter plate 134. The connecting device 14 thus allows the shaft 115 and thus the central milling cutter 11 to be detached from the milling head 1. The central milling cutter 11 can therefore be detached, serviced and reinserted or replaced by a central milling cutter 11 comprising other features.

FIG. 1*b* shows the milling head 1 of FIG. 1*a* while machining a pile head 80 of a pile 8 shown cut open, which comprises a height h1 and a diameter d. The pile core 81 and the pile jacket 82, between which the undamaged iron armouring 83 is held in a relatively thin concrete sleeve 88, have already been removed over a height difference h2 from top to bottom. The loosened milling material was collected by the conveyor shovels 119A, 119B and fed through the transfer openings 1120A, 1120B to the conveyor spirals 113A, 113B and lifted and carried away by these over the pile head 80 and the remaining concrete sleeve 88 respectively. Inside the pile head 80, the milled material is held laterally by a spiral wall 1130, which is formed or welded peripherally to the conveyor spirals 113A, 113B. The milling material is therefore lifted above the pile head 80 and only then, under the effect of centrifugal force, is discharged outwards to the outlet openings 1231 of the mounting cylinder 123.

FIG. 1*b* further shows that the central chisels 111 and the ring chisels 121 are at different heights and thus engage the pile head 80 at different depths. At least the central chisels 111, which are close to the central drill unit 114, are all lower than the ring chisels 121 in the milling direction. Also, on the inner ring plate 112 and the outer ring plate 122 the central chisels 111 and ring chisels 121 are mounted at different heights in the milling direction. The mounting height of the central chisels 111 increases radially in the direction of the rotation axis x, preferably stepwise from central chisel 111 to central chisel 111. The mounting height of the ring chisels 121 increases radially outwards preferably from ring chisel 121 to ring chisel 121 stepwise. A linear or non-linear increase can be provided. The central drill unit 114 itself, which assumes a guiding or pilot function, projects downwards beyond the central chisels 111.

FIG. 1*b* shows a cross-section through the pile head 8 with the symmetrical course of the milling line d1, which, corresponding to the arrangement of the central drill unit 114, of the central chisels 111 and of the ring chisels 121, comprises a maximum in the area of the rotation axis, and is interrupted in the area of the concrete sleeve 88 or in the area of the central circular ring area kr2, and comprises a minimum and subsequently rises again towards the outside in the milling direction. When the pile head 8 is machined, a corresponding waveform concentric to the rotation axis x results on its surface. This waveform ensures that the central milling cutter 11 and the ring milling cutters 12 engage optimally in the pile head 80 and dissolve the pile core 81 from the inside to the outside and the pile jacket 82 from the outside to the inside. This gradual machining of the pile head 80 allows the surface tension in the pile core 81 and the surface tension in the pile jacket 82 to be advantageously released while avoiding damage to the pile head 80.

After finishing the machining of the pile head 80, the milling head 1 is lifted again. The remaining concrete sleeve 88, which still encloses and protects the iron armouring 83, is then removed with little effort using other tools such as milling and clamping.

FIG. 2 shows the milling head 1 from below with a view of the inner ring plate 112 equipped with the central chisels 111 and the outer ring plate 122 equipped with the ring chisels 121, which cover a central circular ring area kr1 corresponding to the pile core 81 and an outer circular ring area kr3 corresponding to the pile jacket 82 in accordance with the geometry of the machined pile 8 and delimit a middle circular ring area kr2, into which a concrete sleeve 88 with the iron armouring 83 remaining after the machining of the pile head 80 can enter. Part of the middle circular ring area kr2 is shown hatched.

The outer ring plate 122 has an outer diameter d1220 and an inner diameter d1221. The inner ring plate 112 has an outer diameter d112.

On the outer ring plate 122, three series 121A, 121B, 1210 of twelve spirally arranged ring chisels 121 or 1211, 1212, . . . , 12112 are each arranged offset by 120°. Three ring chisels 121 each follow the same work circle m1 (only one work circle m1 shown). The mounting height of the ring chisels 121 increases from the first ring chisel 1211 to the last ring chisel 12112 or from one work circle m1 to the next work circle m1 radially from the inside to the outside, preferably continuously, which is why the outermost ring chisels 12112 lie highest in the milling direction and therefore first grip the outer edge of the pile jacket 82. In this way, the pile jacket 82 is machined from the outside inwards, which is why harmful splitting is avoided. The increase in mounting height of the ring chisels 121 is preferably in a range of 5 mm-25 mm. For example, the increase in mounting height of the first ring chisels 1211, 1212, . . . is close to 5 mm and the increase in mounting height of the last ring chisels . . . , 12111, 12112 is close to 25 mm.

Figure 3A:
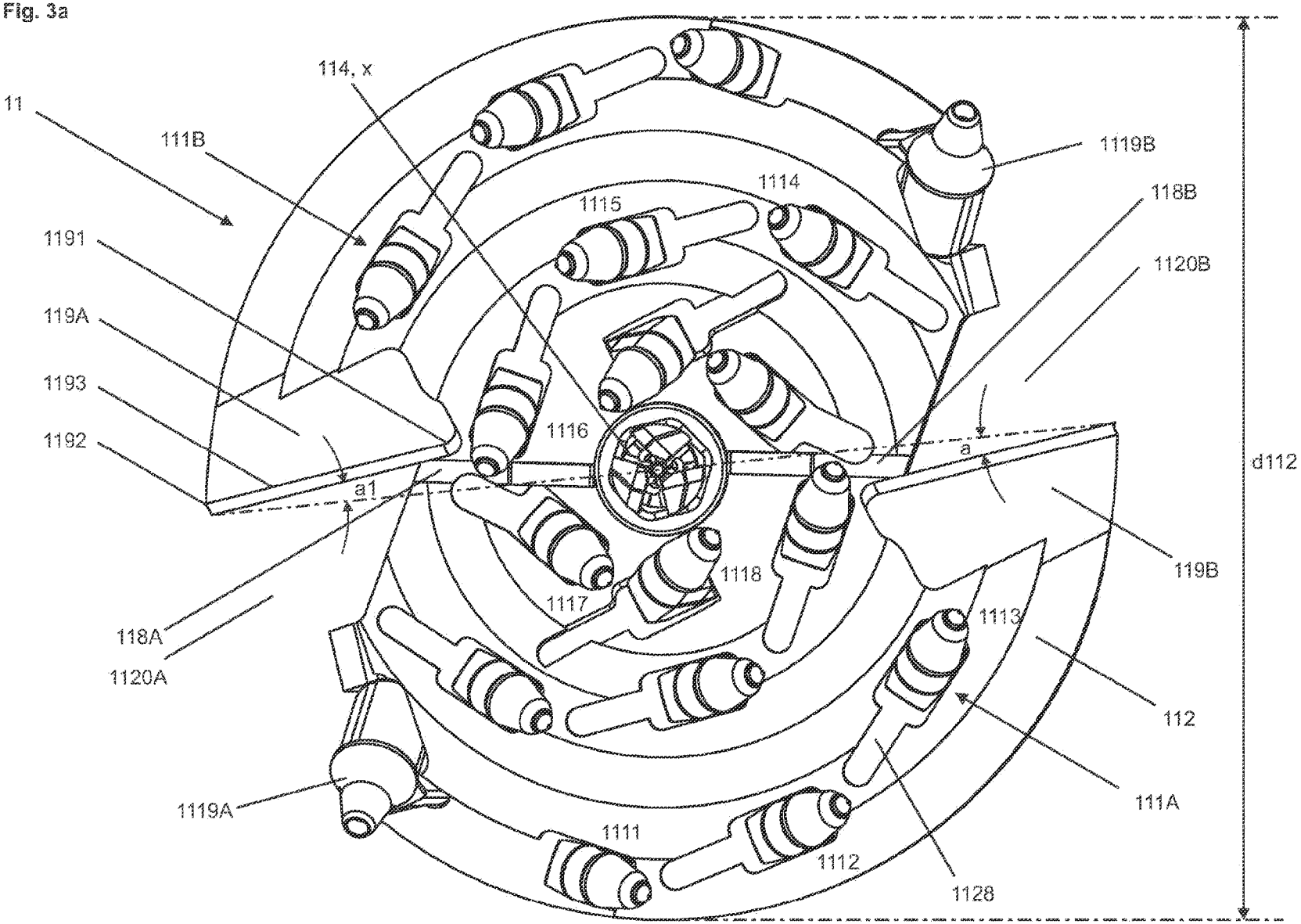
FIG. 3*a* the inner ring plate 112 of FIG. 2, which is equipped with two series 111A, 111B of spirally arranged central chisels 111, a central drill unit 114 and is provided with two transfer openings 1120A, 1120B, which are each adjoined laterally by a radial shovel 118A, 118B and, in the direction of rotation rearwardly, a conveyor shovel 119A, 119B and at the front of each of which a clearing chisel 1119A, 1119B is provided.

On the inner ring plate 112, which is shown larger in FIG. 3*a*, two series 111A, 111B of eight spirally arranged central chisels 111 and 1111, 1112, . . . , 1118 are each arranged offset by 180°.

Figure 3B:
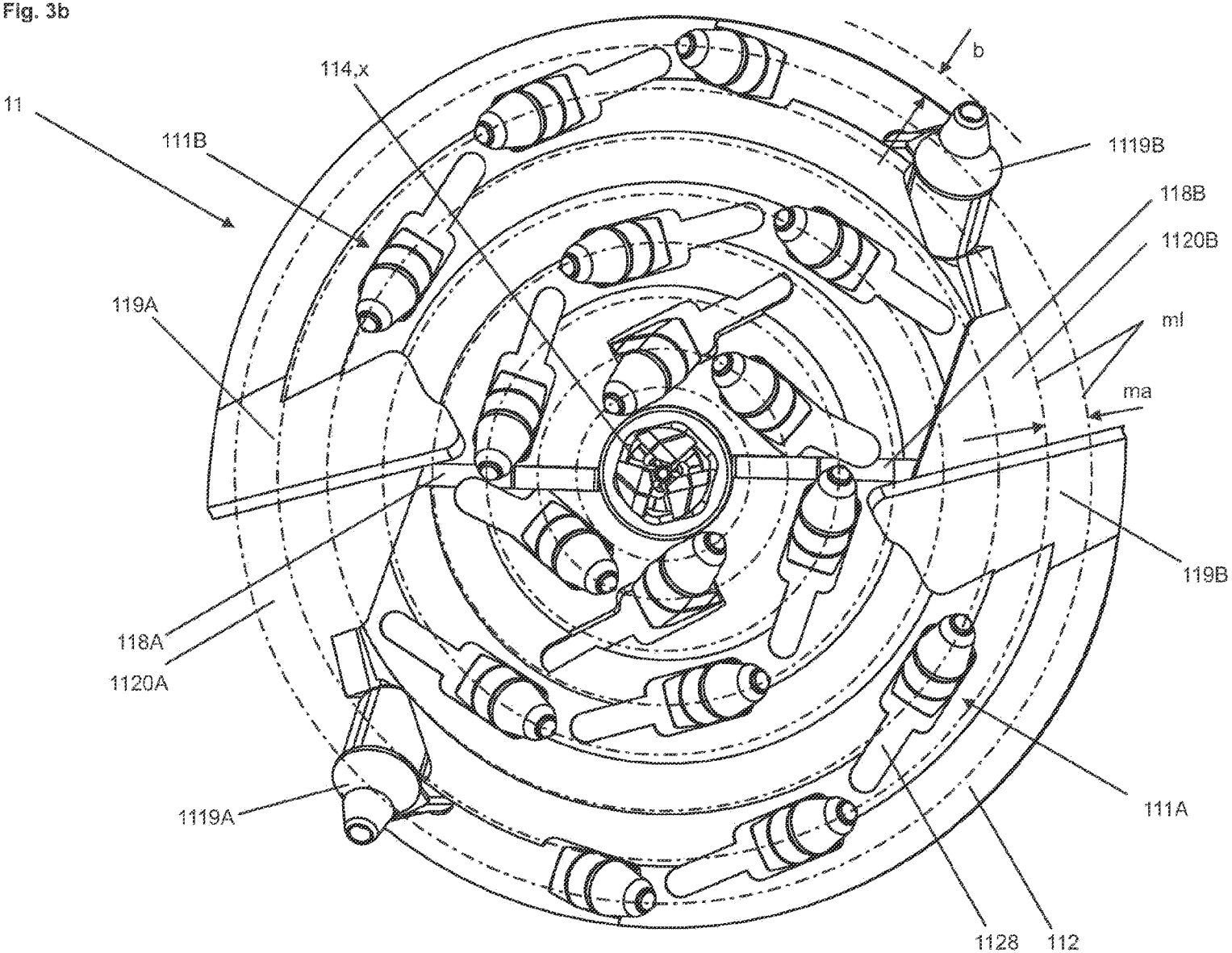
FIG. 3*b* the inner ring plate 112 of FIG. 3*a* with marked work circles m1 of the two series 111A, 111B of central chisels 111, two of which, which are diametrically opposite each other with respect to the rotation axis x of the milling head 1 and the central drill unit 114, respectively, are guided along a common work circle m1.

As FIG. 3*b* shows, two diametrically opposed central chisels 111 follow the same work circle m1. The mounting height of the central chisels 111 increases from the first central chisel 1111 to the last central chisel 1108 radially from the outside to the inside, preferably continuously, which is why the central chisels 1108 lying closest to the rotation axis x lie highest in the milling direction and therefore penetrate first into the centre of the pile core 81 after the central drill unit 114. In this way, the pile core 81 is machined from the inside to the outside, which allows the pile core 81 to be machined more quickly.

For example, the increase in mounting height of the first ring chisels 1111, 1112, . . . is close to 5 mm and the increase in mounting height of the last ring chisels . . . , 1107, 1108 is close to 25 mm.

The central chisels 111 are radially offset from each other in pairs at equal or unequal chisel distances ma and define a work circle m1 during rotation. The difference in the radii of the work circles m1 corresponds to the respective chisel spacing. The uniform chisel spacing ma or the different chisel distances ma are preferably in a range of 20 mm-40 mm. With this arrangement of the central chisels 111 the material is optimally removed. The work circles m1 are thus radially and also vertically offset from each other.

The inner ring plate 112 also comprises two transfer openings 1120A, 1120B diametrically opposite each other with respect to the rotation axis x, through which the loosened milling material can be guided away. For the removal of the milled material, a conveyor shovel 119A, 119B is provided adjacent to the trailing edge of each of the transfer openings 1120A, 1120B, which on the one hand extend partially into the area of the respective transfer opening 1120A, 1120B and on the other hand partially into the working area of the central chisels 111. At the front, the conveyor shovels 119A, 119B comprise a front edge 1193, which extends from an inner edge to an outer edge of the conveyor shovels 119A, 119B. The front edge 1193 of the conveyor shovels 119A, 119B therefore first engages with the exposed milled material in order to guide it away upwards via the conveyor shovels 119A, 119B.

FIG. 3*a* shows that the front edge 1193 is horizontally inclined relative to the diameter d112 of the inner ring plate 112 by a horizontal inclination angle a1 in such a way that, when the milling head 1 rotates in the working direction, the outer edge 1192 of the respective conveyor shovel 119A; 119B precedes and the inner edge 1191 follows behind. The milling material is therefore first caught on the outside of the front edge 1193 and displaced inwards against the corresponding transfer opening 1120A, 1120B. The displacement of the milled material results in a favourable material flow that relieves the load on the conveyor shovels 119A, 119B. The horizontal inclination angle or advance angle a1 is preferably in a range of 0°-25°.

Each of the transfer openings 1120A, 1120B is also associated with a radial shovel 118A, 118B which conveys the milled material exposed by the central drill unit 114 and the inner central chisels 111 outwardly to the transfer openings 1120A, 1120B. The radial shovels 118A, 118B can be simple plates which are preferably form-fittingly held by the inner ring plate 112 and are preferably radially or inclined towards the associated transfer opening 1120A, 1120B.

FIG. 3*b* further shows that a clearing chisel 1119A, 1119B is mounted on the leading edge of each of the transfer openings 1120A, 1120B, which projects outwards beyond the inner ring plate 112 by a clearance width b, which is preferably in a range of 5 mm-40 mm. The clearing chisels 1119A, 1119B pick up concrete particles that have not yet been loosened and could damage the conveyor shovels 119A, 119B, as well as the milling material lying on the outside, and convey it radially inwards so that it can be picked up by the conveyor shovels 119A, 119B. The clearing chisels 1119A, 1119B are preferably identical to the ring chisels 121, which are preferably larger than the central chisels 111.

To ensure that the milled material can be grasped well peripherally, the conveyor shovels 119A, 119B can also project radially outwards beyond the inner ring plate 112 by up to 35 mm.

FIG. 3*b* further shows that the inner ring plate 112 has mounting holes 1128 on the lower side, into which the central chisels 111 or holders for the central chisels 111 are inserted.

Figure 4:
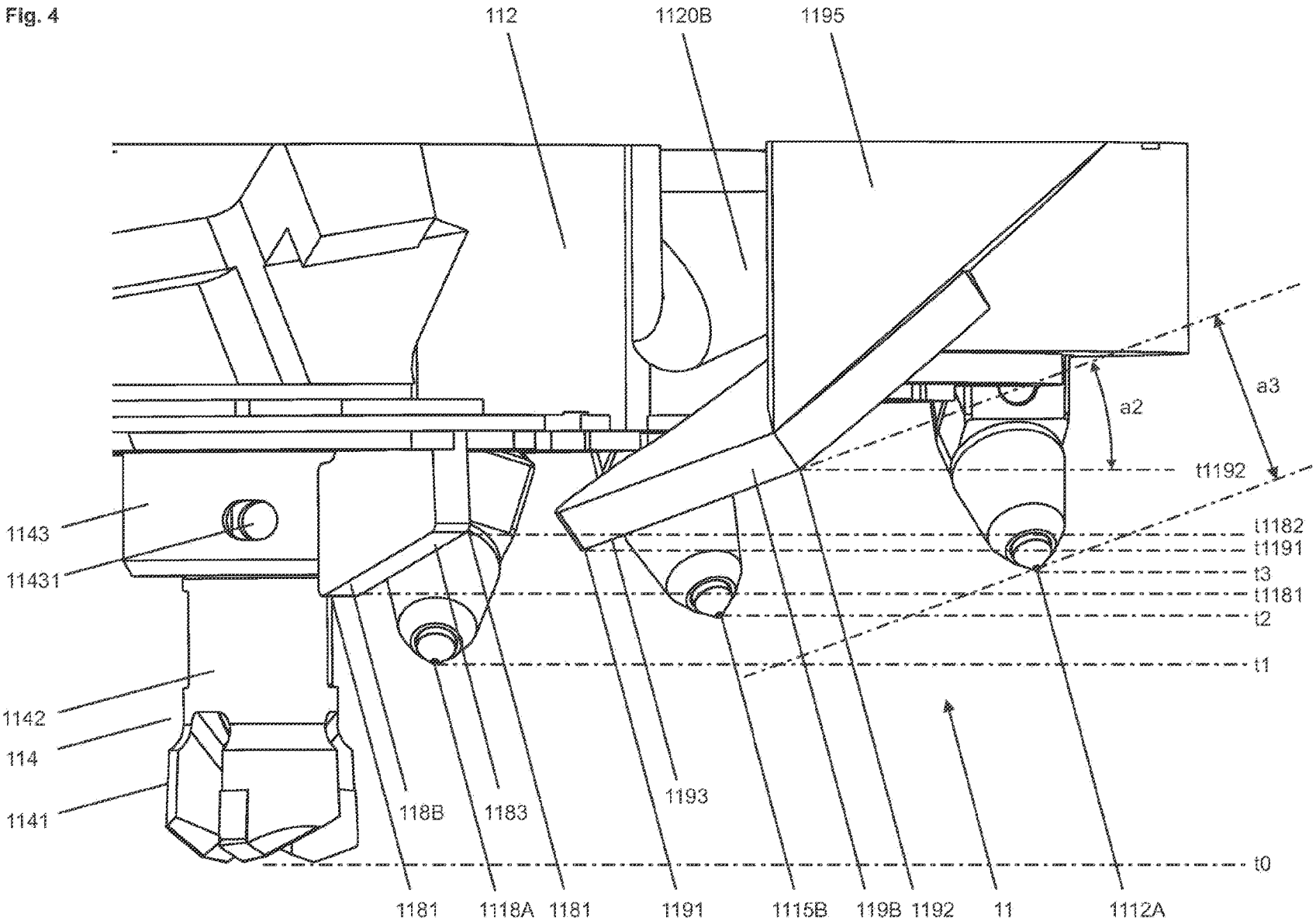
FIG. 4 a part of the central milling cutter 11 with the inner ring plate 112, the central drill unit 114, only three mounted central chisels 1112A, 1115B, 1118A and one of the transfer openings 1120B, to which the associated radial shovel 118B and the associated conveyor shovel 119B, which project into the working area of the central chisels 111, adjoin.

FIG. 4 shows a part of the central milling cutter 11 with the inner ring plate 112, the central drill unit 114, only three mounted central chisels 1112A, 1115B, 1118A and one of the transfer openings 1120B, to which the associated radial shovel 118B and the associated conveyor shovel 119B, which extend into the working area of the central chisels 111, adjoin. For each of these tools the penetration depth is shown; for the central drill unit 114 the penetration depth to, for the central chisels 1112A, 1115B, 1118A the penetration depths t1, t2, t3, for the inner edge 1181 and the outer edge 1182 of the radial shovel 118B the penetration depths t1181, t1182 and for the inner edge 1191 and the outer edge 1192 of the conveyor shovel 119B the penetration depths t1191, 1192.

The front edge 1183 of the radial shovel 118B extends from the inner edge 1181 to the outer edge 1182 or from the penetration depth t1181 to the penetration depth t1182 with a descending outward slope. The front edge 1193 of the conveyor shovel 119B extends from the inner edge 1191 to the outer edge 1192 or from the penetration depth t1191 to the penetration depth t1182 with a descending outward slope.

The front edge 1193 of the conveyor shovel 119B is vertically inclined relative to the diameter d112 of the inner ring plate 112, preferably by a vertical inclination angle a2, in such a way that the inner edge 1191 is preferably higher than the outer edge 1192 in the conveying direction in accordance with the course of the mounting heights of the central chisels 111. The conveyor shovel 119B can therefore not come into contact with the surface of the pile head 80 or the pile core 81.

Preferably, a shovel spacing a3 is provided between the front edge 1193 of the conveyor shovel 119 and the working circles m1 of the central chisels 111 or the tips of the central chisels 111, which lies in a range of preferably 5 mm-40 mm.

FIG. 4 further shows that the central drill unit 114, which comprises a milling tool or drilling tool 1141 and a tool shaft 1142, is held in a mounting part or drill chuck 1143 and fixed by means of a locking part 11431, for example by a bolt.

Figure 5A:
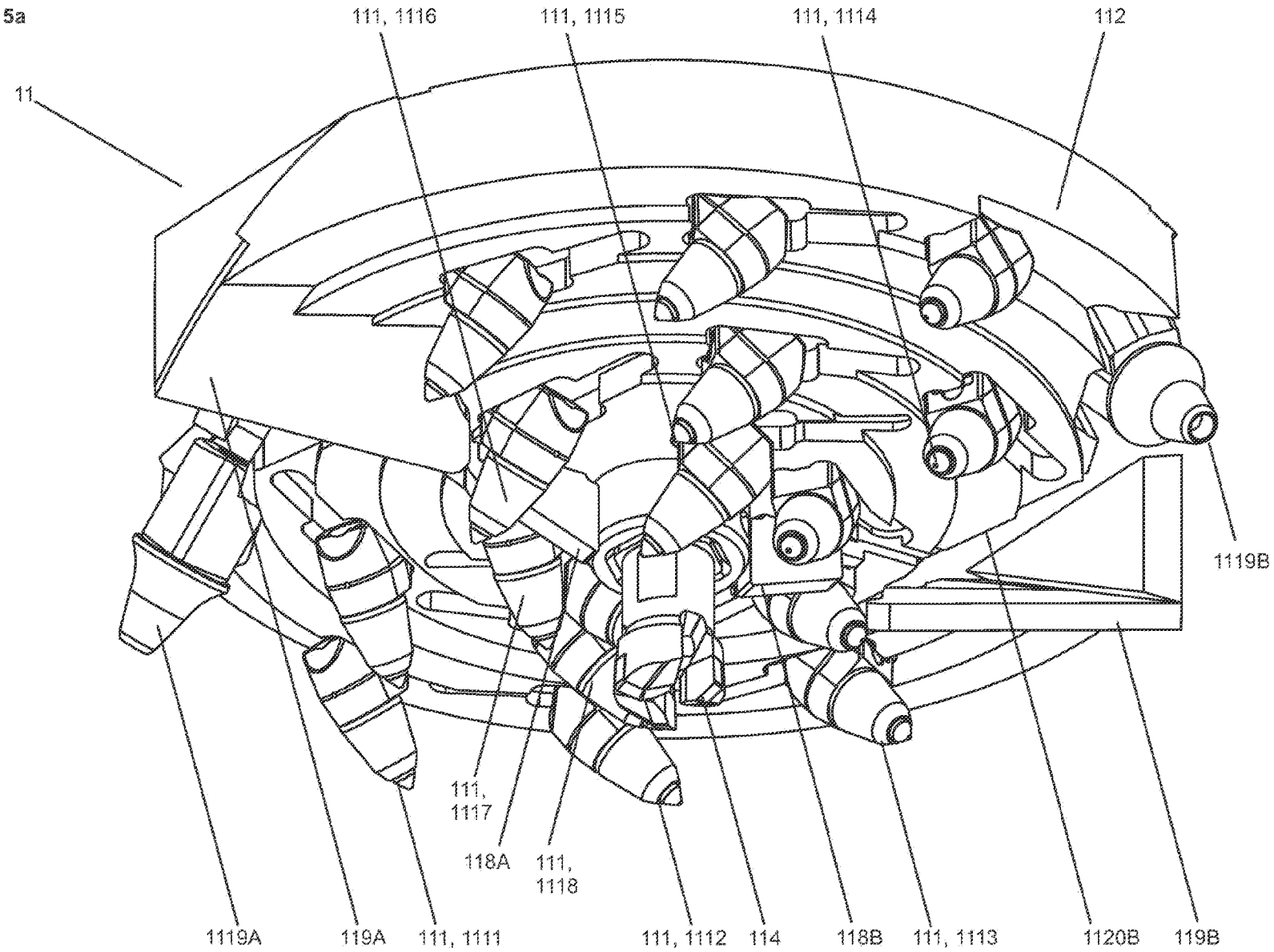
FIG. 5*a* a spatial representation of the inner ring plate 112 of FIG. 3*a*, fully equipped with central chisels 111, radial shovels 118A, 118B, conveyor shovels 119A, 119B, clearing tools 1119A, 1119B and the central drill unit 114.

FIG. 5*a* shows a spatial representation of the inner ring plate 112 of FIG. 3*a*, fully equipped with central chisels 111; radial shovels 118A, 118B; conveyor shovels 119A, 119B; clearing tools 1119A, 1119B; and the central drill unit 114. A series of central chisels 111 is marked with the corresponding order numbers 1111, 1112, . . . , 1108. Furthermore, a view over the conveyor shovel 119B through the transfer opening 1120B is shown on the right.

Figure 5B:
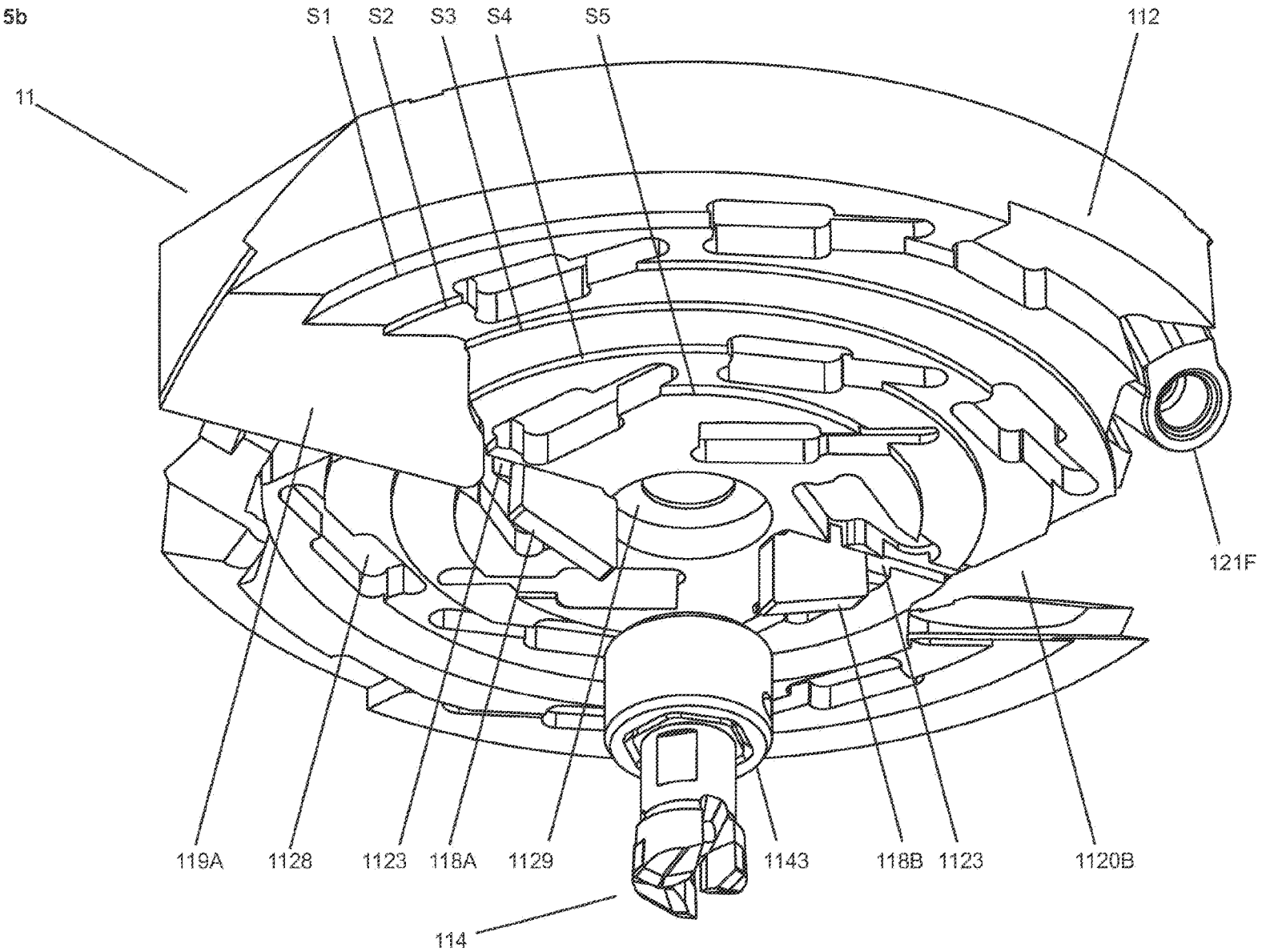
FIG. 5*b* the inner ring plate 112 of FIG. 5*a* after removal of the central chisels 111 and the conveyor shovel 119B as well as the removal of the central drill unit 114 together with the drill chuck 1143 from a recess 1129 of the inner ring plate 112.

FIG. 5*b* shows the inner ring plate 112 of FIG. 5*a* after removal of the central chisels 111 and the conveyor shovel 119B as well as the removal of the central drill unit 114 together with the drill chuck 1143 from a recess 1129 of the inner ring plate 112. Furthermore, recesses 1123 are visible on the lower side of the inner ring plate 112, which serve to accommodate the radial shovels 118A, 118B. The housing 121F of the clearing chisel 1119B is still mounted.

For the realisation of the assembly heights or the mutual vertical displacement of the central chisels 111, the lower side of the inner ring plate 112 is provided with ring-shaped steps S1, S2, S3, S4, S5, which preferably correspond to the working circles m1.

FIG. 6*a* shows the inner ring plate 112 of FIG. 5*a* from above with the conveyor spirals 113A, 113B adjoining the upper: side of the inner ring plate 112 and rotated 180° relative to each other, which surround the shaft 115 of the central milling cutter 11 and which are each provided with a spiral wall 1130 in this section. The transfer opening 1120B is shown, to which the conveying bucket 119B, projecting into the working area of the central chisel 111, adjoins on the underside and to which the conveying spiral 113B adjoins on the upper side. The inner ring plate 112 has a transfer surface 1125A, 1125B for each of the transfer openings 1120A, 1120B, via which the milling material is conveyed from the conveyor shovel 119A, 119B to the associated conveyor spiral 113A, 113B. It is possible to cover this transfer surface 1125A, 1125B completely by the conveyor shovel 119A, 119B. The conveyor shovel 119A, 119B can therefore be welded to the lower end of the transfer surface 1125A, 1125B at the front, for example, or it can be attached to the associated transfer surface 1125A, 1125B, or it can be screwed on.

The conveyor shovel 119B, which adjoins the lower side of the transfer opening 1120B or extends further, is inclined by an inclination angle of the shovel a4 with respect to the rotation axis x and forms an inclined plane. The inclination angle of the shovel a4, with which the conveyor shovel 119B is inclined with the front edge 1193 forwardly below the transfer opening 1120B, is in a range of preferably 5°-85°. Preferably, a vertical orientation of the conveyor shovel 119B is avoided, where the milling material is pushed forward and hardly displaced upwards. The inclination angle of the shovel a4, which in the embodiment shown is about 45°, is therefore selected in such a way that the milled material can pass over the conveyor shovel 119B to the transfer opening 1120B and on to the conveyor spiral 113B. To prevent the conveyed milling material from escaping to the outside, the conveyor shovel 119B comprises an outer wall 1195.

The transfer surface 1125B is preferably shaped in such a way that a preferably laminar transition without obstacles results between conveyor shovel 119B at the entrance of conveyor spiral 113B.

FIG. 6*b* shows the inner ring plate 112 of FIG. 6*a* without the conveyor spirals 113A, 113B, the shaft 115 and the conveyor shovel 119B. After removing the conveyor shovel 119B, a connecting space with a connecting surface 1127 is exposed on the lower edge of the transfer surface 1125B or on the lower side of the transfer opening 1120B, in which the conveyor shovel 119B can be fastened, for example screwed and/or welded. Also exposed are the connecting surfaces 1126A, 1126B for the conveyor spirals 113A, 113B, which extend to an edge or a stop 11261, which is flush with the upper edge of the associated conveyor spiral 113A, 113B, so that the milling material can enter the conveyor spiral 113A, 113B unhindered.

FIG. 7*a* shows a central chisel 111 comprising a holder 111F and a chisel element 111M inserted therein.

FIG. 7*b* shows a ring chisel 121 comprising a holder 121F and a chisel element 121M inserted therein. In the present embodiment, the ring chisel 121 is also used as a clearing chisel, as shown in FIG. 6*b*.

LIST OF REFERENCES 1 milling head
11 central milling cutter
111, 1111, . . . , 1118 central chisels
111A, 111B central chisel group
111F chisel holder
111M chisel or tool
1119A, 1119B clearing tool, clearing chisel
112 inner ring plate
1120A, 1120B transfer openings
1123 mounting holes for the radial shovels
1124 receiving aperture for the shaft 115
1125A, 1125B transfer surfaces of the transfer openings
1126A, 1126B connecting surface for the conveyor spirals
1127 connecting surfaces for the conveyor shovels
1128 mounting holes for central chisels 111
1129 receiving aperture for the mounting part 1143
113A, 113B conveyor spirals
1130 spiral wall
114 central drill unit
1141 milling tool, hard metal cutting edges
1142 tool shaft

1143 mounting part, drill chuck
11431 locking part
115 shaft
118A, 118B radial shovels
1181 inner edge of the radial shovels
1182 outer edge of the radial shovels
1183 front edge of the radial shovels
119A, 119B conveyor shovel
1191 inner edge of the conveyor shovels
1192 outer edge of the conveyor shovels
1193 front edge of the conveyor shovels
1195 outer wall of the conveyor shovels
12 ring milling cutter
121; 1211, . . . , 12112 ring chisels
121A, . . . , 131C ring chisel groups
121F chisel holder
121M chisel or tool
122 outer ring plate
123 mounting cylinder
1231 exit window
1232 mounting window for access
13 coupling device
131 coupling sleeve
132 coupling means, coupling bolt
133 coupling plate
134 counter plate
14 connecting device
2 drive shaft
8 pile
81 pile core
82 pile jacket
83 metal armouring
88 concrete sleeve
a1 horizontal inclination angle of the front edge
a2 vertical inclination angle of the front edge
a3 shovel spacing
a4 inclination angle of the shovel
b clearance width
d pile diameter
d112 outer diameter of the inner ring plate
d122*i* inner diameter of the outer ring plate
d122*o* outer diameter of the outer ring plate
d1 milling line along the pile diameter
h1 pile height
h2 pile head height
kr1, central circular ring area
kr2 middle circular ring area
kr3 outer circular ring area
ma chisel spacing
m1 chisel lines, work circles
S1, . . . , S5 steps at the inner ring plate 112
t0 penetration depth of the central drill units
t1 penetration depth of the central chisel 1118A
t2 penetration depth of the central chisel 1115B
t3 penetration depth of the central chisel 1112A
t1181 penetration depth inner edge radial shovel
t1182 penetration depth outer edge radial shovel
t1191 penetration depth inner edge conveyor shovel
t1192 penetration depth outer edge conveyor shovel
(FIG. 1*b*)

The invention claimed is:

1. A milling head having a rotation axis for machining a pile head of a pile that comprises a pile core, a pile jacket and a metal armouring interposed therebetween, with a coupling device, which is connectable to a drive shaft of a driving device, with a central milling cutter, which comprises a plurality of central chisels mounted on a lower side of an inner ring plate, wherein the inner ring plate comprises at least one transfer opening leading from the lower side to an upper side of the inner ring plate, which the at least one transfer opening is adjoined on the lower side of the inner ring plate by at least one conveyor shovel projecting at least partially into a working area of the plurality of central chisels and which the at least one transfer opening is adjoined on the upper side of the inner ring plate by at least one conveyor spiral, and wherein a central drill unit is arranged on the lower side of the inner ring plate, which is aligned coaxially to the rotation axis and projects beyond the plurality of central chisels and a plurality of ring chisels in a milling direction, and in that the at least one conveyor shovel is provided on the lower side of the inner ring plate, which the at least one conveyor shovel adjoins the central drill unit and is aligned radially with respect to the rotation axis.

2. The milling head according to claim 1, with a ring milling cutter, which comprises the plurality of ring chisels mounted on a lower side of an outer ring plate, which the central milling cutter and the ring milling cutter are connected to each other coaxially aligned with the rotation axis, and which the outer ring plate surrounds the inner ring plate separated thereof by a middle circular ring area.

3. The milling head according to claim 1, wherein the at least one transfer opening includes two transfer openings, the inner ring plate comprises the two transfer openings, each transfer opening of the two transfer openings is adjoined on the lower side of the inner ring plate by the at least one conveyor shovel projecting at least partially into the working area of the plurality of central chisels and each of which is adjoined on the upper side of the inner ring plate by the at least one conveyor spiral.

4. The milling head according to claim 1, wherein the at least one transfer opening includes a plurality of transfer openings, the at least one conveyor shovel includes a plurality of conveyor shovels, and the plurality of transfer openings, the plurality of conveyor shovels and the plurality of central chisels lie diametrically opposite each other in pairs with respect to the rotation axis and at equal distances from the rotation axis.

5. The milling head according to claim 1, wherein the inner ring plate is connected to a lower side of a shaft and an outer ring plate is connected to a lower side of a mounting cylinder, and that the shaft and the mounting cylinder are aligned coaxially to the rotation axis and are connected at their upper side to a coupling plate on which the coupling device is arranged.

6. The milling head according to claim 1, wherein, one conveyor spiral of the at least one conveyor spiral or two conveyor spirals of the at least one conveyor spiral, which are turned 180° relative to each other, is or are provided with a side wall in a lower section, which is selected according to the height of the pile head to be machined.

7. The milling head according to claim 1, wherein the central drill unit is releasably held in a mounting part or drill chuck which is inserted into a receiving aperture on the lower side of the inner ring plate.

8. The milling head according to claim 1, wherein the plurality of central chisels are each radially offset from one another either at equal radial chisel spacings in a range of 20 mm-40 mm or unequal radial chisel spacings in the range of 20 mm-40 mm.

9. The milling head according to claim 1, wherein the plurality of central chisels are each radially spaced at equal or unequal chisel distances on work circles, wherein a mounting height of the plurality of central chisels in the milling direction changes from one work circle to the next work circle by a height difference and increases in a direction of the rotation axis.

10. The milling head according to claim 1, wherein the plurality of ring chisels are each radially offset from one another at equal or unequal chisel spacings and define work circles during rotation, wherein a mounting height of the plurality of ring chisels increases radially outwards in the milling direction from one work circle to the next work circle by a height difference which lies in a range of 5 mm-25 mm.

11. The milling head according to claim 1, wherein the central drill unit, the plurality of central chisels and the plurality of ring chisels which lie at different mounting heights form in their engagement area or with work circles a waveform which runs concentrically to the rotation axis, which has a maximum mounting height in the region of the rotation axis in the milling direction, which has a minimum mounting height in the region of a central circular ring area and which rises again towards the outer edge of an outer ring plate in the milling direction.

12. The milling head according to claim 1, wherein the at least one conveyor shovel comprises a front edge which extends from an inner edge lying closer to the rotation axis to an outer edge lying farther away from the rotation axis, which front edge is inclined horizontally relative to the diameter of the inner ring plate by a horizontal inclination angle in such a way that, during the rotation of the milling head in the working direction, the outer edge precedes and the inner edge follows behind.

13. The milling head according to claim 1, wherein the at least one conveyor shovel comprises a front edge which extends from an inner edge lying closer to the rotation axis to an outer edge lying farther away from the rotation axis, which front edge is inclined vertically relative to the diameter of the inner ring plate by a vertical inclination angle in such a way that, in accordance with the course of the mounting height of the plurality of central chisels, the inner edge lies higher than the outer edge.

14. The milling head according to claim 1, wherein the at least one conveyor shovel comprises a front edge which extends from an inner edge lying closer to the rotation axis to an outer edge lying farther away from the rotation axis, which front edge is set back over the entire length by a shovel spacing in the range of 5 mm-40 mm in the milling direction relative to work circles of the plurality of central chisels.

15. The milling head according to claim 1, wherein the at least one conveyor shovel is inclined by a vertical inclination angle of the shovel relative to the rotation axis, wherein a front edge of the at least one conveyor shovel is leading and the inclination angle of the at least one conveyor shovel is in a range of 5°-85°.

16. The milling head according to claim 1, wherein the plurality of central chisels are each radially spaced at equal or unequal chisel distances on work circles, wherein a mounting height of the plurality of central chisels in the milling direction changes from one work circle to the next work circle by a height difference that is in a range of 5 mm-25 mm, and increases in a direction of the rotation axis.

* * * * *